US006590556B2

(12) United States Patent
Hector et al.

(10) Patent No.: US 6,590,556 B2
(45) Date of Patent: Jul. 8, 2003

(54) ACTIVE MATRIX DISPLAY DEVICE

(75) Inventors: Jason R. Hector, Sutton (GB); Neil C. Bird, Horsham (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/935,882

(22) Filed: Aug. 23, 2001

(65) Prior Publication Data

US 2002/0024494 A1 Feb. 28, 2002

(30) Foreign Application Priority Data

Aug. 25, 2000 (GB) ..... 0020999

(51) Int. Cl.[7] ..... G09G 3/36
(52) U.S. Cl. ..... 345/92; 345/98; 345/100
(58) Field of Search ..... 345/92, 87, 98–100

(56) References Cited

U.S. PATENT DOCUMENTS 5,130,829 A 7/1992 Shannon ..... 359/59
6,373,419 B1 * 4/2002 Nakao ..... 341/154
6,407,732 B1 * 6/2002 Stiens et al. ..... 345/204
6,504,522 B2 * 1/2003 Shiraki et al. ..... 345/98

FOREIGN PATENT DOCUMENTS

WO WO9952012 10/1999 ..... G02F/1/136
WO PCT/EP01/09444 * 3/2002

* cited by examiner

*Primary Examiner*—Richard Hjerpe
*Assistant Examiner*—Francis Nguyen

(57) ABSTRACT

A display device has row driver circuitry (30) providing row address signals and column address circuitry (32) providing pixel drive signals. The row address signals comprise a plurality of voltage levels (V1–V4) to implement a desired drive scheme. The column address circuitry comprises circuitry (70) for generating low voltage representations of at least some of the row address signals. The row address circuitry comprises a conversion circuit (72) for converting the representations into the row address signal levels, at least one of has a high voltage magnitude. The invention provides an architecture which partitions different sections of the row voltage supply circuitry optimally between the row and column drivers. This enables a simplified power supply to be provided which can be made more power efficient.

18 Claims, 7 Drawing Sheets

ACTIVE MATRIX DISPLAY DEVICE

This invention relates to active matrix display devices, in particular having a pixel configuration using a thin film transistor switching device.

This type of display typically comprises an array of pixels arranged in rows and columns. Each row of pixels shares a row conductor which connects to the gates of the thin film transistors of the pixels in the row. Each column of pixels shares a column conductor, to which pixel drive signals are provided. The signal on the row conductor determines whether the transistor is turned on or off, and when the transistor is turned on, by a high voltage pulse on the row conductor, a signal from the column conductor is allowed to pass on to an area of liquid crystal material, thereby altering the light transmission characteristics of the material. An additional storage capacitor may be provided as part of the pixel configuration to enable a voltage to be maintained on the liquid crystal material even after removal of the row electrode pulse. U.S. Pat. No. 5,130,829, whose contents are incorporated herein by reference, discloses in more detail the construction and driving of examples of such an active matrix display device.

The frame (field) period for active matrix display devices requires a row of pixels to be addressed in a short period of time, and this in turn imposes a requirement on the current driving capabilities of the transistor in order to charge or discharge the liquid crystal material to the desired voltage level. In order to meet these current requirements, the gate voltage supplied to the thin film transistor needs to fluctuate between values separated by approximately 30 volts. For example, the transistor may be turned off by applying a gate voltage of around −10 volts, or even lower, (with respect to the source) whereas a voltage of around 20 volts, or even higher, may be required to bias the transistor sufficiently to provide the required source-drain current to charge or discharge the liquid crystal material sufficiently rapidly.

The requirement for large voltage swings in the row conductors requires the row driver circuitry to be implemented using high voltage components.

The voltages provided on the column conductors typically vary by approximately 10 volts, which represents the difference between the drive signals required to drive the liquid crystal material between white and black states. Various drive schemes have been proposed enabling the voltage swing on the column conductors to be reduced, so that lower voltage components may be used in the column driver circuitry. In the so-called "common electrode drive scheme", the common electrode, connected to the full liquid crystal material layer, is driven to an oscillating voltage. The so-called "four-level drive scheme" uses more complicated row electrode waveforms in order to reduce the voltage swing on the column conductors, using capacitive coupling effects.

Whilst these drive schemes enable lower voltage components to be used for the column driver circuitry, they each result in more complicated row conductor waveforms, in particular having a plurality of voltage levels. This makes the row driver circuitry more complicated, and has conventionally been achieved by using a plurality of voltage supply circuits to generate the different row electrode voltages.

The invention is concerned with the generation of these row voltages.

According to the invention, there is provided a display device comprising an array of liquid crystal pixels, each pixel comprising a thin film transistor switching device and a liquid crystal cell, the array being arranged in rows and columns, wherein each row of pixels shares a row conductor, which connects to the gates of the thin film transistors of the pixels in the row, and wherein each column of pixels shares a column conductor to which pixel drive signals are provided, wherein row driver circuitry provides row address signals for controlling the switching of the transistors of the pixels of the row, and column address circuitry provides the pixel drive signals, wherein the row address signals comprise a plurality of voltage levels, and wherein the column address circuitry comprises circuitry for generating representations of at least some of the row address voltage levels, and wherein the row address circuitry comprises a conversion circuit for converting the representations into the row address levels.

The invention provides a first section of the row signal generating circuitry in the column address circuitry, and a second section in the row driver circuitry. The row driver circuitry is in any case required to switch high voltages on to the row conductors, so must be implemented using high voltage components. The invention thereby provides an architecture which partitions different sections of the row voltage supply circuitry optimally between the row and column drivers. This enables a simplified power supply to be provided which can be made more power efficient.

Preferably the representations comprise relatively low voltage signals (for example of magnitude less than 10V) and the row address levels comprise relatively high voltage signals (for example of magnitude greater than 10V).

The low voltage section generates equivalents of the voltages used in the row driver to address the display. These are the different voltage levels required by the particular addressing scheme being used, together with the common electrode voltage which may also adopt a number of different levels.

The representations, which comprise the equivalents of the voltages used in the row driver, may comprise digital representations or scaled analogue representations. The conversion circuit will then either comprise digital to analogue conversion circuitry or else analogue amplification circuitry. These representation voltages may be corrected for kickback correction, temperature effects and may allow a brightness control.

The representations may be generated only once for each frame period. The regularity with which the voltages must be regenerated depends upon the amount of leakage from the circuitry used.

The simplification of the power supply enables the row address circuitry to be driven by only two power rails. Thus, the digital to analogue converters or amplifiers may be powered from these two rails, avoiding the need in the row driver circuitry for multiple power sources.

The display device may, for example, be used in a mobile telephone.

The invention also provides a column address circuit and a row address circuit, which are adapted to enable the display device architecture to be implemented.

The invention also provides a method of generating row address signals for an active matrix liquid crystal display device, wherein the row address signals comprise a plurality of voltage levels, the method comprising:

in column address circuitry, generating representations of at least some of the row address levels, the representations comprising relatively low voltage signals, in row driver circuitry, converting the representations into the relatively high voltage row address levels, and forming the row address signals from the row address levels.

Examples of the invention will now be described in detail with reference to the accompanying drawings, in which.

Figure 1:
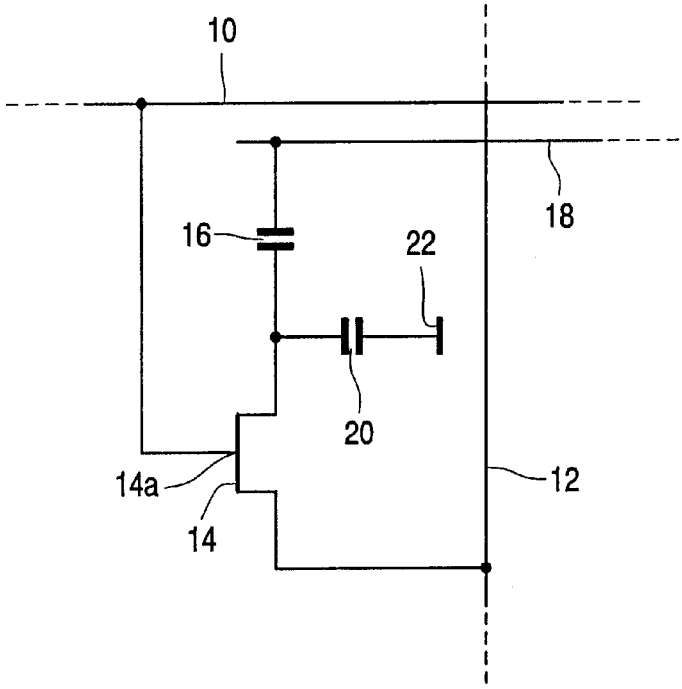
FIG. 1 shows one example of a known pixel configuration for an active matrix liquid crystal display.

FIG. 1 shows a conventional pixel configuration for an active matrix liquid crystal display. The display is arranged as an array of pixels in rows and columns. Each row of pixels shares a common row conductor 10, and each column of pixels shares a common column conductor 12. Each pixel comprises a thin film transistor 14 and a liquid crystal cell 16 arranged in series between the column conductor 12 and a common potential 18. The transistor 14 is switched on and off by a signal provided on the row conductor 10. The row conductor 10 is thus connected to the gate 14*a* of each transistor 14 of the associated row of pixels. Each pixel may additionally comprise a storage capacitor 20 which is connected at one end 22 to the next row electrode, to the preceding row electrode, or to a separate capacitor electrode. This capacitor 20 stores a drive voltage so that a signal is maintained across the liquid crystal cell 16 even after the transistor 14 has been turned off.

In order to drive the liquid crystal cell 16 to a desired voltage to obtain a required gray level, an appropriate signal is provided on the column conductor 12 in synchronism with a row address pulse on the row conductor 10. This row address pulse turns on the thin film transistor 14, thereby allowing the column conductor 12 to charge the liquid crystal cell 16 to the desired voltage, and also to charge the storage capacitor 20 to the same voltage. At the end of the row address pulse, the transistor 14 is turned off, and if a storage capacitor 20 is used then this maintains a voltage across the cell 16 when other rows are being addressed. The storage capacitor 20 reduces the effect of liquid crystal leakage and reduces the percentage variation in the pixel capacitance caused by the voltage dependency of the liquid crystal cell capacitance. The rows are addressed sequentially so that all rows are addressed in one frame period, and refreshed in subsequent frame periods.

Figure 2:
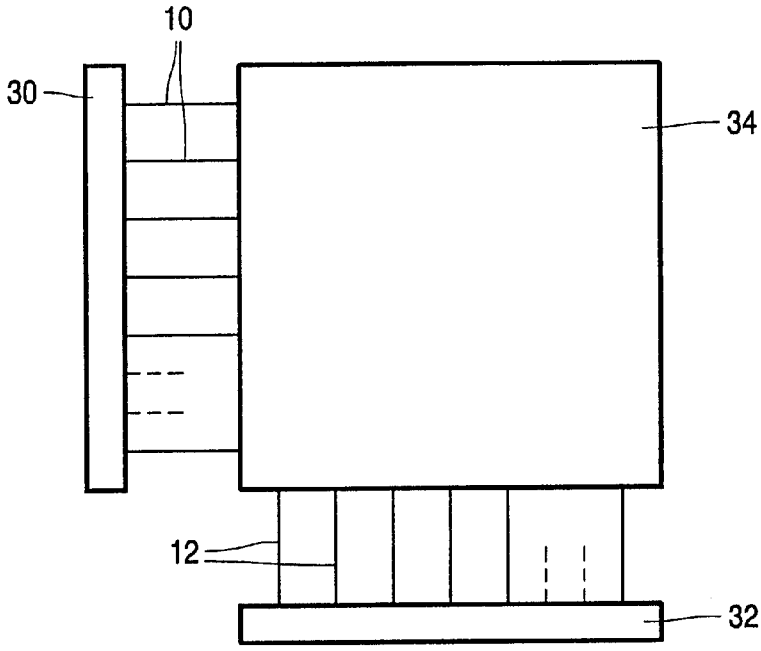
FIG. 2 shows a display device including row and column driver circuitry.

As shown in FIG. 2, the row address signals are provided by row driver circuitry 30, and the pixel drive signals are provided by column address circuitry 32, to the array 34 of display pixels.

In order to enable a sufficient current to be driven through the thin film transistor 14, which is implemented as an amorphous silicon thin film device, a high gate voltage must be used. In particular, the period during which the transistor is turned on is approximately equal to the total frame period within which the display must be refreshed, divided by the number of rows. It is well known that the gate voltage for the on-state and the off-state differ by approximately 30 volts in order to provide the required small leakage current in the off-state, and sufficient current flow in the on-state to charge or discharge the liquid crystal cell 16 within the available time. As a result, the row driver circuitry 30 uses high voltage components.

Figure 3:
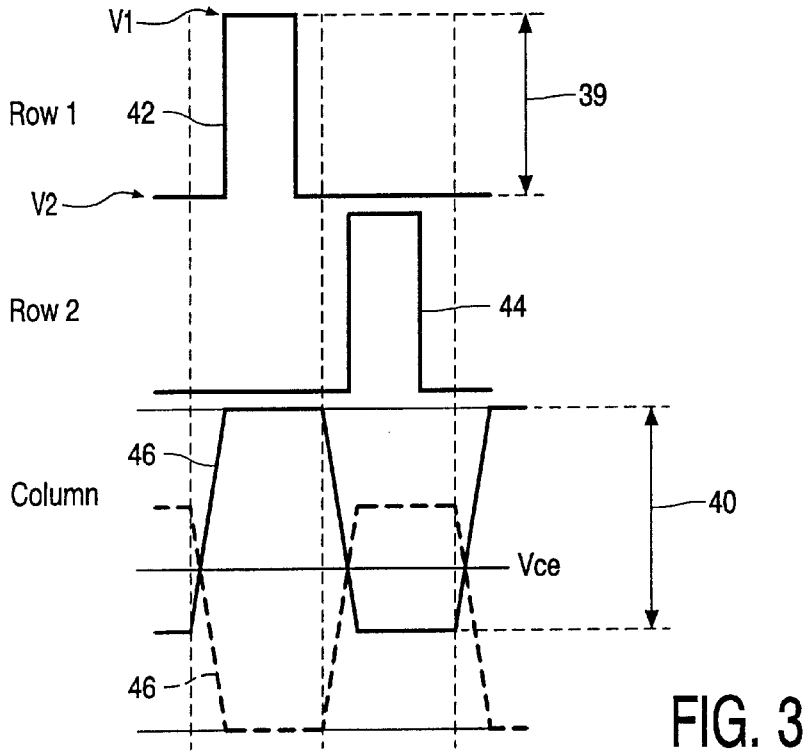
FIGS. 3 to 5 show different (known) row waveforms which may be used in the driving of an active matrix display.

FIG. 3 shows a first example of a known addressing scheme for driving the display of FIG. 1. A signal applied to each row comprises a rectangular pulse having a height 39 of approximately 30 volts. The required oscillation of the column signal, in order to oscillate from a transmissive to a non-transmissive state of the liquid crystal material typically has a voltage fluctuation 40 of around 10 volts. The row waveforms in FIG. 3 represent the row driver pulse 42 for one row, the row driver pulse 44 for a subsequent row, and the signal to be applied to the column conductor as row waveforms 46. It is known to alternately charge the liquid crystal material to positive and negative voltages, so that the average voltage across the LC cell during operation is zero. This prevents degradation of the material and is known as inversion, and is represented in FIG. 3 by the dashed column waveforms.

Figure 4:
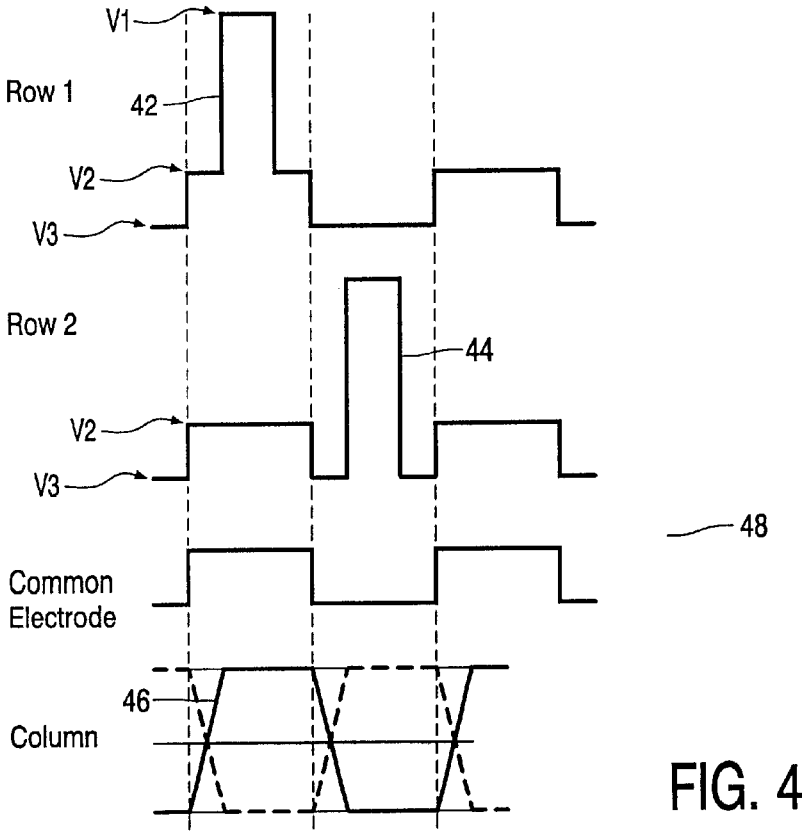

The voltage swing on the column electrode signal required by the drive scheme of FIG. 3 also requires the column address circuitry 32 to be implemented using high voltage components. However, alternative drive schemes exist with the aim of reducing the voltage swing on the column electrode 12, thereby enabling the column address circuitry 32 to be implemented using low voltage components. FIG. 4 shows a first example of an alternative known drive scheme, known as "common electrode drive". In this case, the voltage on the common electrode 18 is no longer constant, and is caused to fluctuate. This is shown at plot 48. This enables the voltage swing on the column electrode 12 to be reduced. However, this drive scheme requires a more complicated row waveform, and as illustrated in FIG. 4, each row pulse has three discrete voltages V1, V2, V3 defining the row signal waveform.

Figure 5:
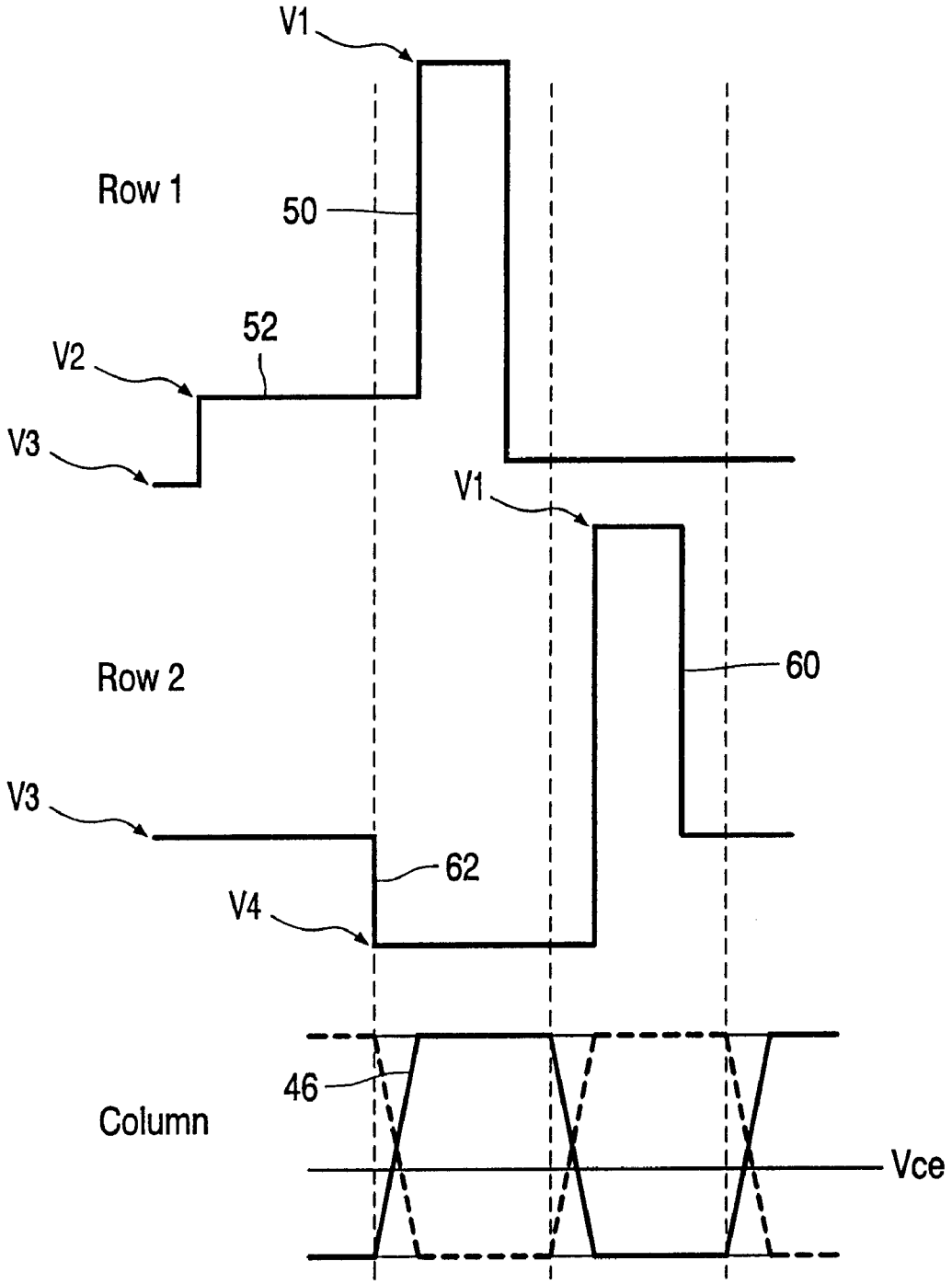

A further known alternative drive scheme is illustrated in FIG. 5, in which capacitive coupling between adjacent rows is relied upon to enable the voltage swing on the column electrode 12 to be reduced. This scheme requires pixel configurations with storage capacitors connected to an adjacent row. In this scheme, a row pulse 50 for one row is preceded by an incremental step increase 52, whereas the row pulse 60 for the next row is proceeded by an incremental step decrease 62. This intermediate step levels may be provided on both sides of the pulse 50, 60 or only at the input to the pulse 50, 60.

These drive schemes will be well known to those skilled in the art, and some of these operational techniques are described in greater detail, for example in U.S. Pat. No. 5,130,829 and WO 99/52012, and these documents are incorporated herein by way of reference material.

The invention is applicable to any particular row waveform, and for this reason, no further explanation will be given of the precise operation of any particular drive scheme. This will be well known to those skilled in the art.

Figure 6:
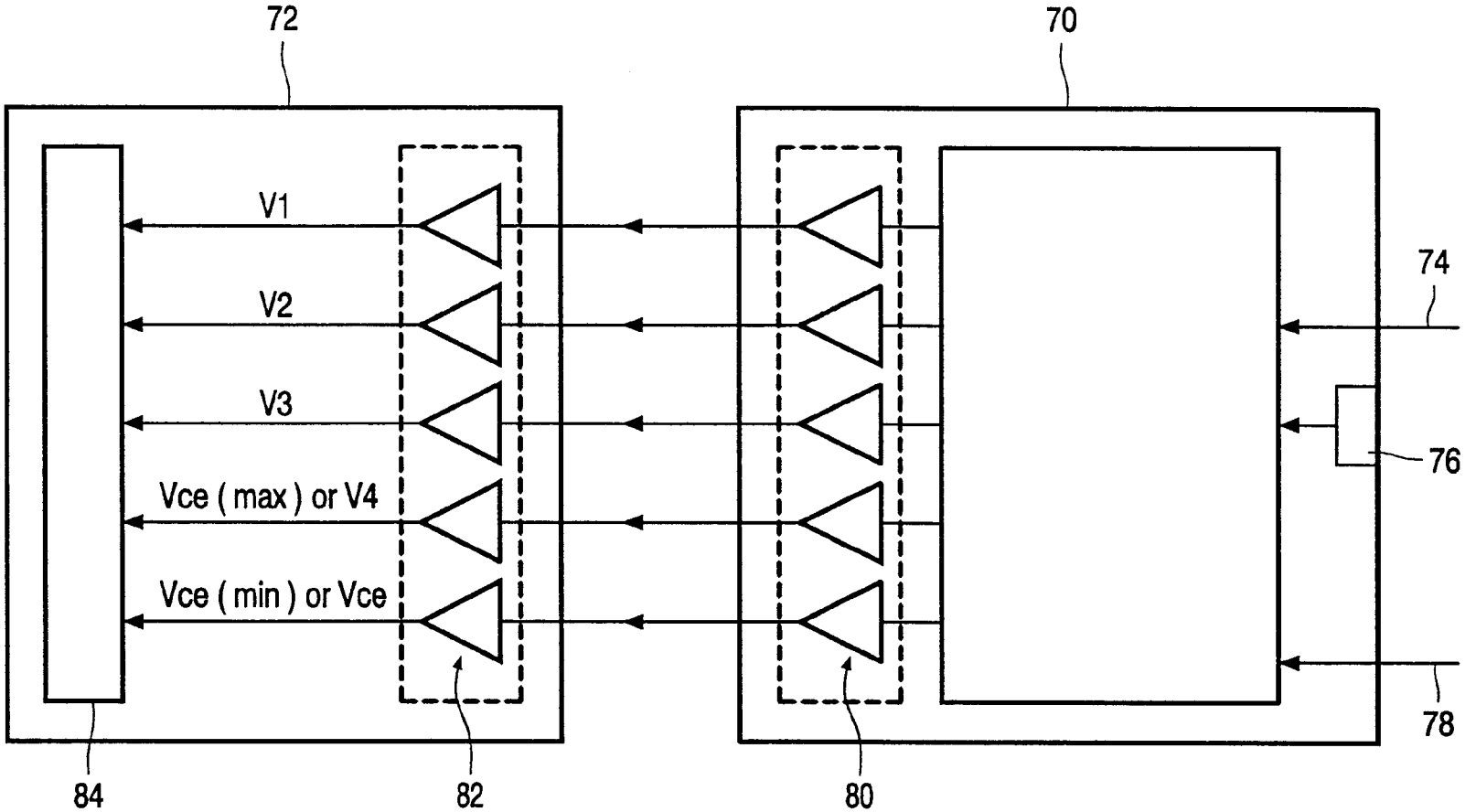
FIG. 6 shows a first example of circuitry for generating row signals in accordance with the invention.

FIG. 6 shows a first example of circuitry for generating the multiple row signal levels in accordance with the invention. The circuitry comprises a relatively low voltage section 70 which is provided in the column address circuitry and a relatively high voltage section 72 provided in the row driver circuitry. The low voltage section 70 generates equivalents of the voltages used in the row driver to address the display. These voltages are V1 to V4 and the common electrode voltage for the capacitively coupled drive scheme described briefly with reference to FIG. 5, or else voltages V1 to V3 together with the two common electrode voltage levels for the drive scheme described briefly with reference to FIG. 4. The low voltage circuit 70 may be provided with inputs 74 providing a kickback or flicker signal, input 76 providing band gap reference signals and a brightness control signal 78. These input signals may be used to provide compensated row voltage equivalents which take account of kickback, flicker and temperature. The adjustment of row voltages to provide compensation for these effects is also well known to those skilled in the art, and will not be described in this text.

The voltages produced in the low voltage part 70 of the circuit typically lie in the range 0–10 volts or 0–5 volts, and comprise representations of the voltage levels which make up the row address signals. These signals are provided to buffers 80 which hold the required voltages at their outputs.

The outputs from the low voltage circuit 70 are provided to the high voltage circuit 72 in the row driver circuitry. The high voltage circuit comprises amplifiers 82 which provide the required row and common electrode voltages to the remainder 84 of the row driver circuitry.

FIG. 6 shows an analogue system, in which the representations provided by the low voltage circuit 70 are analogue, and the conversion of these representations into the required row address signals comprises an analogue amplification operation.

Figure 7:
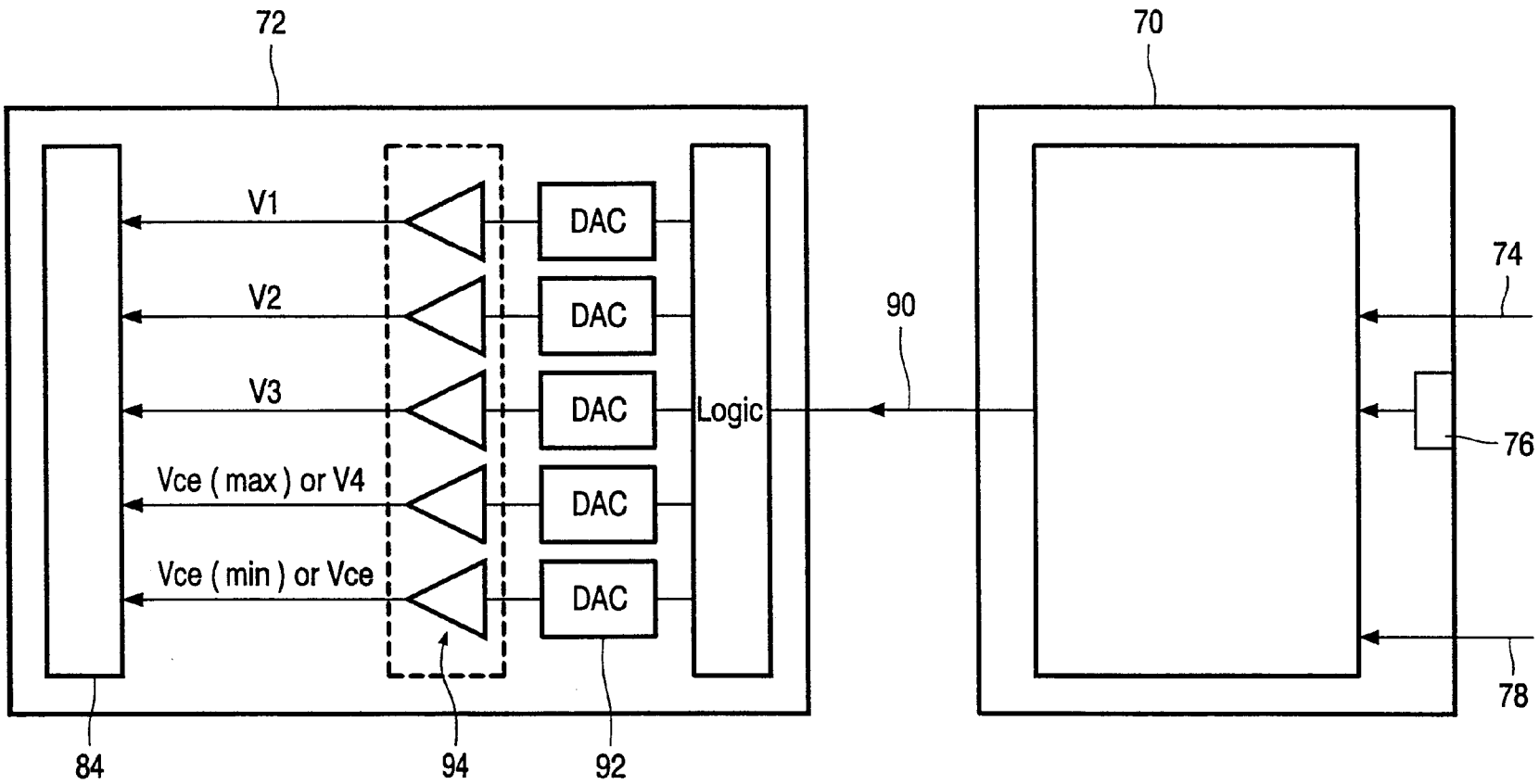
FIG. 7 shows a second example of circuitry for generating row signals in accordance with the invention.

The process may instead be carried out digitally, and FIG. 7 shows an example of this arrangement. Again, the circuit comprises a low voltage section 70 and a high voltage section 72, with the low voltage section having inputs to enable compensation for kickback correction, temperature effects and brightness control. However, the output of the low voltage section 70 comprises digital signals, provided along a digital interface 90 to the high voltage section 72. The high voltage section 72 then comprises digital to analogue converters 92 and output buffers 94 which provide as output the desired row address signals. Unit 84 again represents the remainder of the row driver circuitry.

In each case, the derivation of the voltages is only required rarely, for example once per frame or less, as a voltage can be stored before the buffer in the digital case, and before the amplifier in the analogue case, for example using a sample and hold circuit. This minimises the power consumption within the circuit.

The invention enables a simplified power supply to be implemented in the row driver circuitry.

Figure 8:
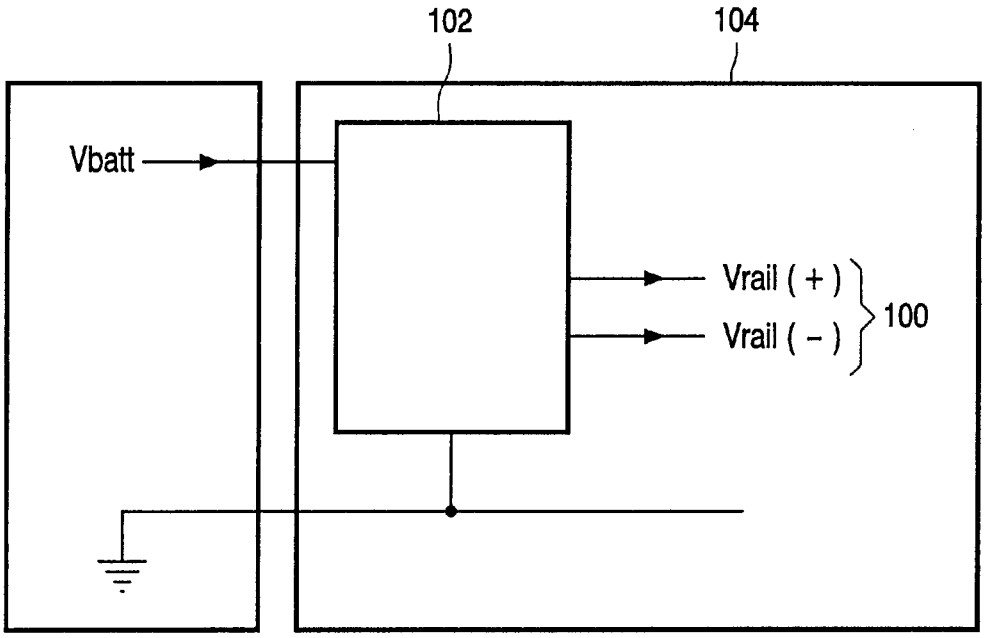
FIG. 8 shows a first power supply arrangement for use in the display of the invention.

FIG. 8 shows a first power supply arrangement for use in the display of the invention. The amplifiers 82 or D/A converters 92 and buffers 94 are supplied by two voltage rails 100 Vrail(+) and Vrail(−), so that a simple power supply 102 is required. This power supply 102 may be integrated into the row driver circuitry. For battery operated devices, for example hand held electronic equipment having a display 104, the power supply is powered by a battery voltage Vbatt. In order to scale this voltage to the required levels for the row drive signals, capacitive or inductive transformation is carried out. This is possible as a result of the low current requirements of the display device.

The amplifier or buffer outputs then provide the different voltage levels required. The power for the column address circuit can also be derived from the upper power rail Vrail(+) or else may be derived independently.

Figure 9:
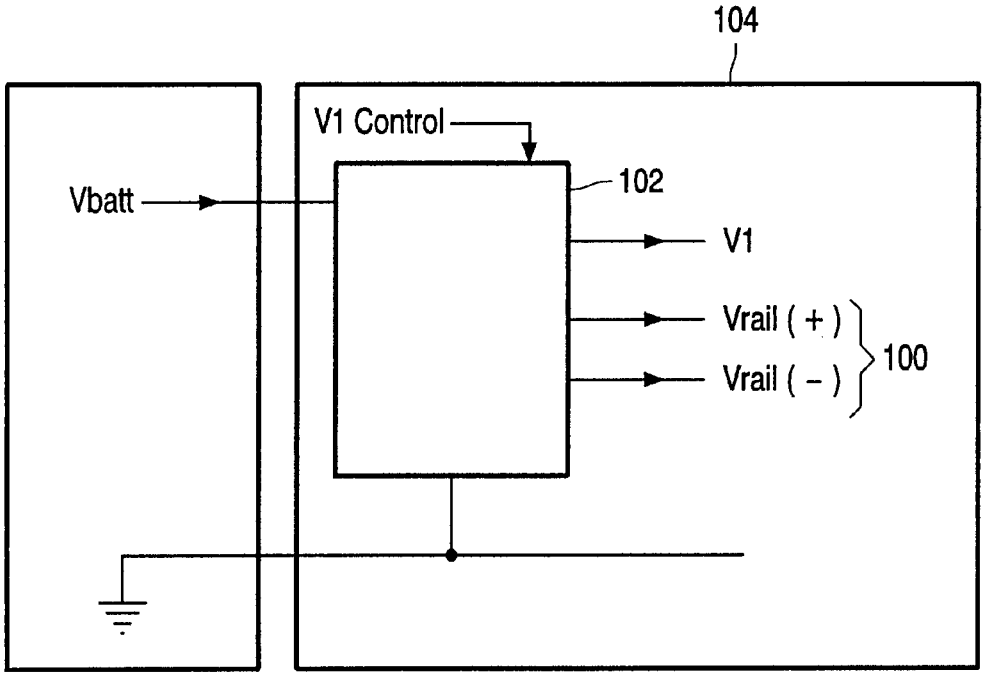
FIG. 9 shows a second power supply arrangement for use in the display of the invention.

FIG. 9 shows a second power supply arrangement for use in the display of the invention. In this case, the highest voltage (V1 of FIGS. 3, 4 or 5) may be generated separately by the power source 102. In particular, this voltage may be of the order of 20V whereas all other required voltages are likely to be in the range of approximately−10V to 6V. In this case, V1 or Vrail(+) may be used to derive the power supply for the column address circuitry.

Figure 10:
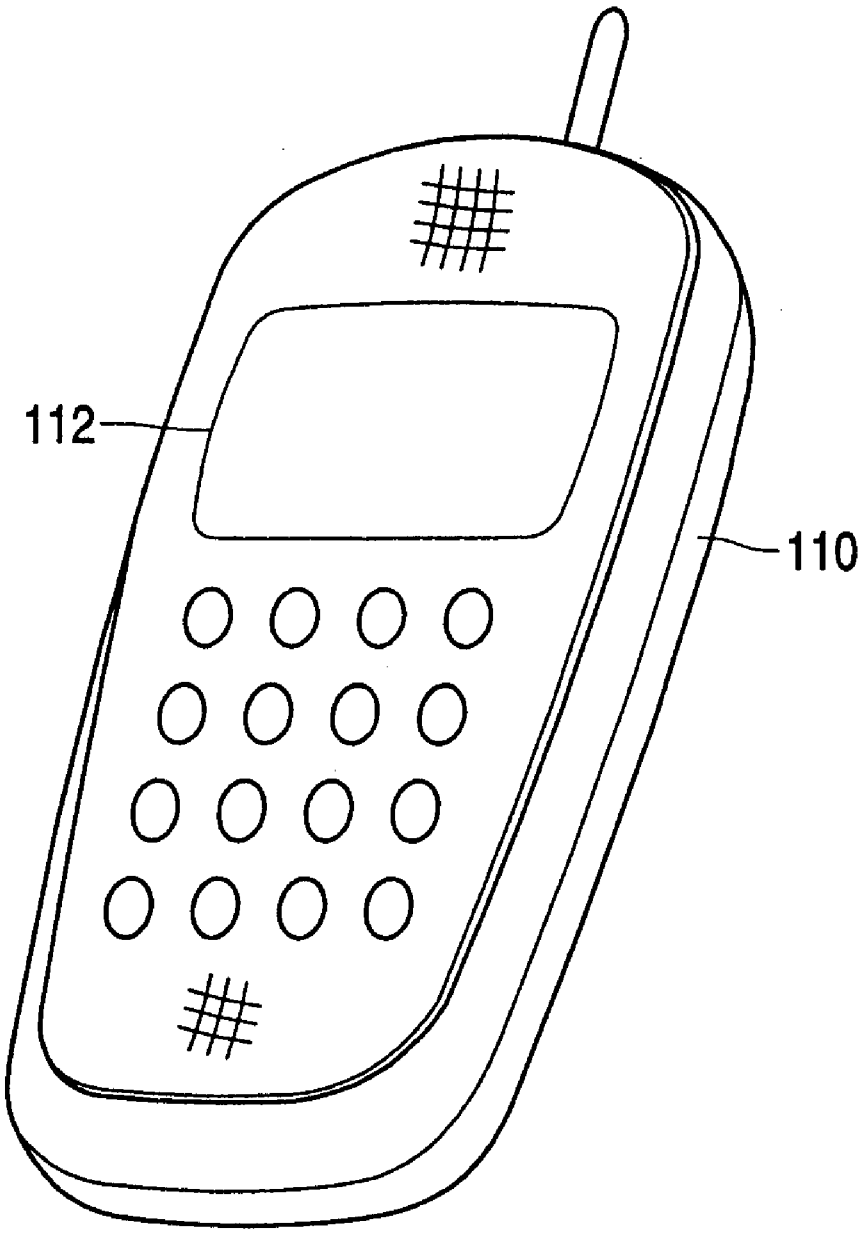
FIG. 10 shows a mobile telephone using the display of the invention.

FIG. 10 shows a mobile telephone 110 having a display device 112 of the invention. The row driver circuitry comprises a power supply 102 (FIG. 8 or 9) which generates from a battery power source the two power rails and the column address circuitry power source.

The invention provides an architecture which enables efficient compensation in the low voltage stage for kickback and temperature effects, and enables a more efficient power supply to be implemented.

The terms "row" and "column" are somewhat arbitrary in the description and claims. These terms are intended to clarify that there is an array of elements with orthogonal lines of elements sharing common connections. Although a row is normally considered to run from side to side of a display and a column to run from top to bottom, the use of these terms is not intended to be limiting in this respect.

The row and column circuits may be implemented as integrated circuits, and the invention also relates to the row and column circuits for implementing the display architecture described above.

Other features of the invention will be apparent to those skilled in the art.

What is claimed is:

1. A display device comprising an array of liquid crystal pixels, each pixel comprising a thin film transistor switching device and a liquid crystal cell, the array being arranged in rows and columns, wherein each row of pixels shares a row conductor, which connects to the gates of the thin film transistors of the pixels in the row, and wherein each column of pixels shares a column conductor to which pixel drive signals are provided, wherein row driver circuitry provides row address signals for controlling the switching of the transistors of the pixels of the row, and column address circuitry provides the pixel drive signals, wherein the row address signals comprise a plurality of voltage levels, and wherein the column address circuitry comprises circuitry for generating representations of at least some of the row address voltage levels, and wherein the row address circuitry comprises a conversion circuit for converting the representations into the row address levels.

2. A device as claimed in claim 1, wherein the representations comprise relatively low voltage signals and the row address levels comprise relatively high voltage signals.

3. A device as claimed in claim 2, wherein the representations have voltage magnitudes less than 10 Volts, and at least one of the row address levels has a voltage magnitude greater than 10 Volts.

4. A device as claimed in claim 1, wherein the representations comprise digital representations of the row address levels (V1–V4), and the conversion circuit comprises digital to analogue conversion circuitry (92).

5. A device as claimed in claim 1, wherein the representations comprise scaled representations of the row address levels (V1–V4), and the conversion circuit comprises amplification circuitry (82).

6. A device as claimed in claim 1, wherein the representations generated by the column address circuitry (32) are compensated to account for kickback and/or brightness control and/or bandgap.

7. A device as claimed in claim 1, wherein the representations are generated at most once for each frame period.

8. A device as claimed in claim 1, wherein the row address circuitry is driven by two power rails (100).

9. A mobile telephone having a display device as claimed in any preceding claim, wherein the row driver circuitry comprises a power supply which generates from a battery power source two power rails for driving the row address circuitry.

10. A mobile telephone as claimed in claim 9, wherein the power supply further provides a high voltage output as one of the row address levels, the remaining row address levels being provided by conversion of the representations.

11. A column address circuit for an active matrix display device, in which device row driver circuitry provides row address signals having a plurality of levels, the column address circuit being provided for generating pixel drive signals, and further comprising circuitry for generating representations of at least some of the row address levels, the representations comprising relatively low voltage signals for conversion by the row address circuitry into relatively high voltage row address levels.

12. A circuit as claimed in claim 11, implemented as an integrated circuit.

13. A row driver circuit for an active matrix display device for providing row address signals having a plurality of levels, in which device column address circuitry provides pixel drive signals and relatively low voltage representations of at least some of the row address levels, wherein the row address circuit comprises a conversion circuit for converting the representations into relatively high voltage row address levels and for forming the row address signals from the row address levels.

14. A method of generating row address signals for an active matrix liquid crystal display device, wherein the row address signals comprise a plurality of voltage levels, the method comprising:

in column address circuitry, generating representations of at least some of the row address levels, the representations comprising relatively low voltage signals, in row driver circuitry, converting the representations into the relatively high voltage row address levels, and forming the row address signals from the row address levels.

15. A method as claimed in claim 14, wherein the representations comprise scaled representations of the row address levels, and the conversion is carried out by amplification circuitry.

16. A method as claimed in claim 14, wherein the representations comprise digital representations of the row address levels, and the conversion is carried out by digital to analogue conversion circuitry.

17. Display driver circuitry comprising a row driver circuit as recited in claim 13.

18. Display driver circuitry comprising a column address circuit as recited in claim 11.

* * * * *